US005967884A

United States Patent [19]

Takubo et al.

[11] Patent Number: 5,967,884

[45] Date of Patent: Oct. 19, 1999

[54] BUFFING MACHINE FOR LENS

[75] Inventors: Sadao Takubo; Norio Okimoto, both of Takehara, Japan

[73] Assignee: Takubo Machine Works Co., Ltd., Hiroshima-Ken, Japan

[21] Appl. No.: 08/852,428

[22] Filed: May 7, 1997

[30] Foreign Application Priority Data

Oct. 7, 1996 [JP] Japan ..... 8-284635
Jan. 24, 1997 [JP] Japan ..... 9-025897

[51] Int. Cl.[6] ..... B24B 9/14
[52] U.S. Cl. ..... 451/255; 451/43
[58] Field of Search ..... 451/43, 251, 256, 451/255, 24

[56] References Cited

U.S. PATENT DOCUMENTS 2,203,003 6/1940 Weber et al. ..... 451/256
3,353,303 11/1967 Stern ..... 451/256
4,870,784 10/1989 Ramos et al. ..... 451/251
4,908,996 3/1990 Friedman et al. ..... 451/43

OTHER PUBLICATIONS

Brochure "Starmaster Automatic Lens Edge Polisher"; Novamatic Systems (2–Pages) Sep. 1986.
Novamatic Systems, Inc. 4–Page brochure Sep. 1986.
Novamatic Systems, Inc. letter from Jay D. Wallace dated Jul. 7, 1998 (1–Page).

*Primary Examiner*—Robert A. Rose
*Attorney, Agent, or Firm*—Nields, Lemack & Dingman

[57] ABSTRACT

The present invention provides a buffing machine for lens, which comprises chuck shafts for chucking a lens of eyeglasses and for rotatably supporting the lens of eyeglasses and a buff wheel for lens for buffing end surface of the lens of eyeglasses, wherein a rotation axis of the buff wheel is tilted with respect to the chuck shafts, and a buffing surface of the buff wheel is a conical curved surface.

5 Claims, 8 Drawing Sheets

BUFFING MACHINE FOR LENS

BACKGROUND OF THE INVENTION

The present invention relates to a buffing machine for lens, and in particular to a buffing machine for lens used to polish end surfaces of lenses of eyeglasses.

Among eyeglasses currently in practical use, frameless eyeglasses have no frame to accommodate lenses and the eyeglasses are used with end surfaces of the lenses exposed to outside. In this respect, end surfaces of the lenses are polished by buffing to finish them as mirror surfaces.

Now, description will be given on a conventional type buffing machine for lens, referring to FIG. 11 and FIG. 12.

In the figure, reference numeral 1 represents a lens of eyeglasses, and the lens 1 of eyeglasses is held by lens chuck shafts 2 of the buffing machine for lens and 2 via lens chucks 3 and 3, and there is provided a buff wheel 4, which has a rotation axis in parallel to an axis of the lens chuck shaft 2. The buff wheel 4 is produced by sewing a buff cloth 5 together. The lens chuck shaft 2 is rotatably mounted on a tiltable frame (not shown) and is rotated by a motor (not shown) installed on the frame.

In case end surface of the lens 1 of eyeglasses is to be buffed, it is chucked by the lens chuck shafts 2 and 2. Then, the frame not shown in the figure is laid down, and the end surface of the lens 1 of eyeglasses is brought into contact with the rotating buff wheel 4 while the lens 1 of eyeglasses is being rotated.

In the buffing machine for lens as described above, the surface of the buff cloth 5 is fluffy. As seen in FIG. 12, fluffs 6 on the surface of the buff cloth 5 are raised perpendicularly with respect to the peripheral end surface of the buff wheel 4 due to centrifugal force caused by the rotation of the buff wheel 4. The front surface of the lens is usually curved toward +side (i.e. convex side), and the fluffs 6 buff or polish peripheral edges of front surface of the lens 1 of eyeglasses. Various types of coating 7 are coated on the lens to protect the lens body or to increase transmittance of light. There have been problems in that the coating 7 on peripheral edges of the lens is damaged by the fluffs 6. In the conventional type buffing machine, buff having high rigidity such as hard buff, felt buff, etc. has been used so that the end of the lens is not buried in the buff. Therefore, it is easy to buff end surface of the lens when end surface is flat, but if end surface is V-shaped, only tips of the end surface of the lens touch the surface of the buff, and it is difficult to buff the entire end surface of the lens.

SUMMARY OF THE INVENTION

It is an object of the present invention to provide a buffing machine for lens, by which it is possible to buff the lens without damaging the coating of the lens when end surfaces of the lens are buffed. It is another object of the invention to provide a buffing machine, by which it is possible to buff not only a lens having end surface in flat shape but also a lens having a V-shaped end surface.

To attain the above objects, the buffing machine for lens according to the present invention comprises chuck shafts for chucking a lens of eyeglasses and for rotatably supporting the lens of eyeglasses and a buff wheel for lens for buffing end surface of the lens of eyeglasses, wherein a rotation axis of the buff wheel is tilted with respect to the chuck shafts, and a buffing surface of the buff wheel is a conical curved surface. Also, the buffing machine for lens of the present invention has the rotation axis of the buff wheel which is tilted in such direction that fluffs of the buff wheel being directed away from the surface of the lens during buffing. Further, the buffing machine for lens of the present invention has the peripheral portion of the buff wheel is designed to be loose. The buffing machine for lens of the invention has an derricking frame for supporting the chuck shafts is elevatably supported, buffing pressure is mainly given by self-weight of a lens support including the derricking frame, a balance spring is arranged on the derricking frame side, and the balance spring is contracted or expanded according to an angle of the derricking frame to hinder change of the buffing pressure. Further, the buffing machine for lens of the present invention comprises an arm rotatably mounted on the derricking frame, a tip of the arm is brought into contact with a side to support the derricking frame, and the balance spring is stretched across the derricking frame and the arm. The buffing machine for lens of the present invention has a buffing pressure adjusting lever rotatably mounted on the derricking frame, and a balance spring is provided between the buffing pressure adjusting lever and the arm.

DETAILED DESCRIPTION OF THE PREFERRED EMBODIMENT

Figure 1:
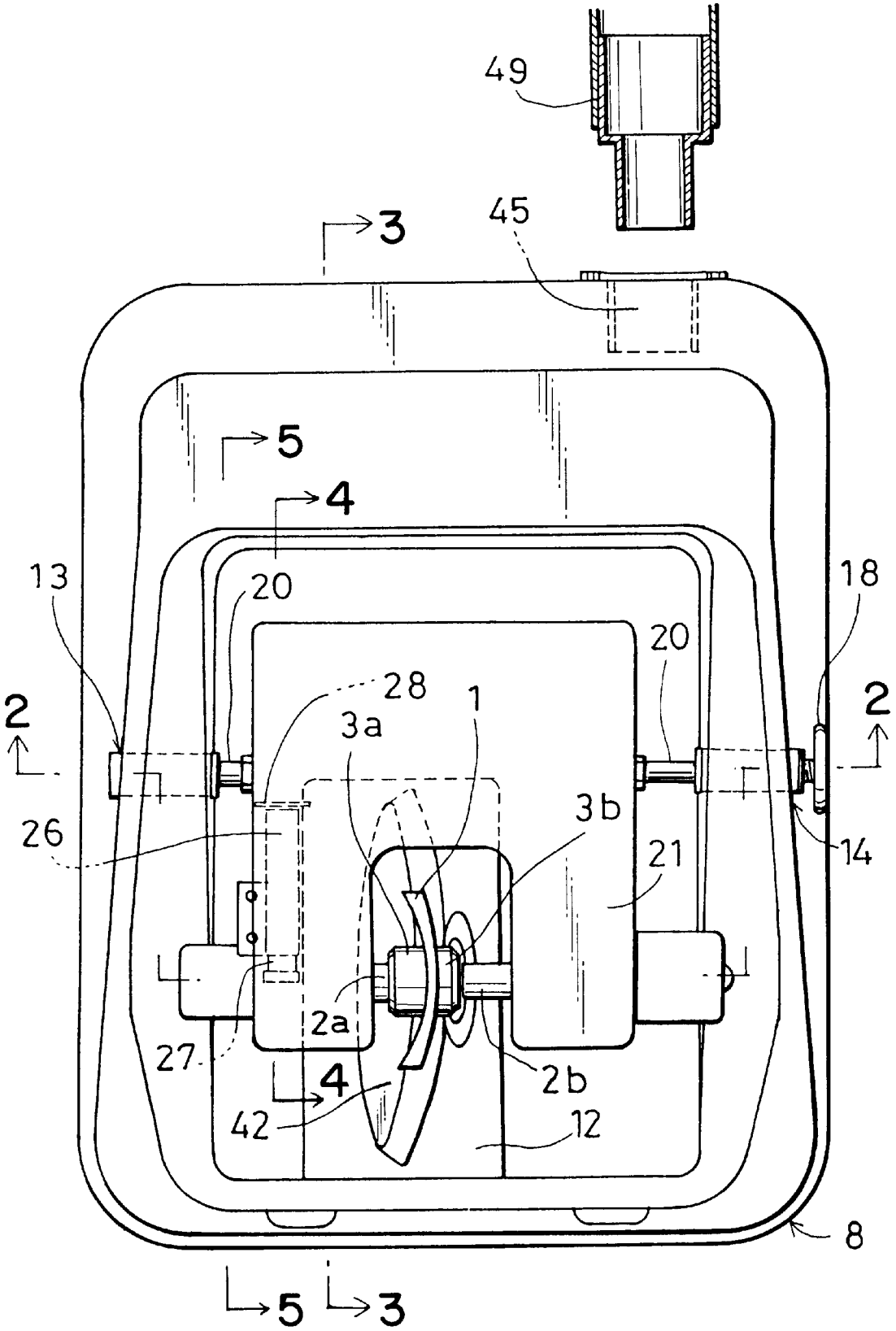
FIG. 1 is a plan view of an embodiment of the present invention.

In the following, description will be given on an embodiment of the present invention referring to the attached drawings.

FIG. 1 to FIG. 5 each represents an essential portion of a mechanical part of the present embodiment. A case 8 comprises an upper case 9 and a lower case 10. On the upper surface of the upper case 9, a U-shaped wall 11 is formed to surround the rear portion of the upper surface of upper case 9. Rear portion of the wall 11 is protruded. On the front portion of the upper case 9, a recess 12 in shape of a half-disk is formed. On side portions 11*a* and 11*b* of the wall 11, shaft supports 13 and 14 are coaxially installed to penetrate the side portions 11*a* and 11*b*.

On one of the shaft supports 13, a floater 16 is slidably arranged in a cylinder with closed bottom 15, and a compression spring 17 is placed in the cylinder with closed bottom 15. By the compression spring 17, the floater 16 is pushed in a direction to protrude. The other shaft support 14 has a tube 22 with both ends opened. Threads are provided on inner side of the tube 22, and a positioning adjusting bolt 18 is engaged with the thread from outer side of the shaft support 14.

On each of the shaft supports 13 and 14, an derricking shaft 20 is rotatably engaged. The derricking shafts 20 and 20 are mounted on and protruded from an derricking frame 21, which is rotatably supported on the wall 11 by the derricking shafts 20 and 20 and the shaft supports 13 and 14.

Figure 2:
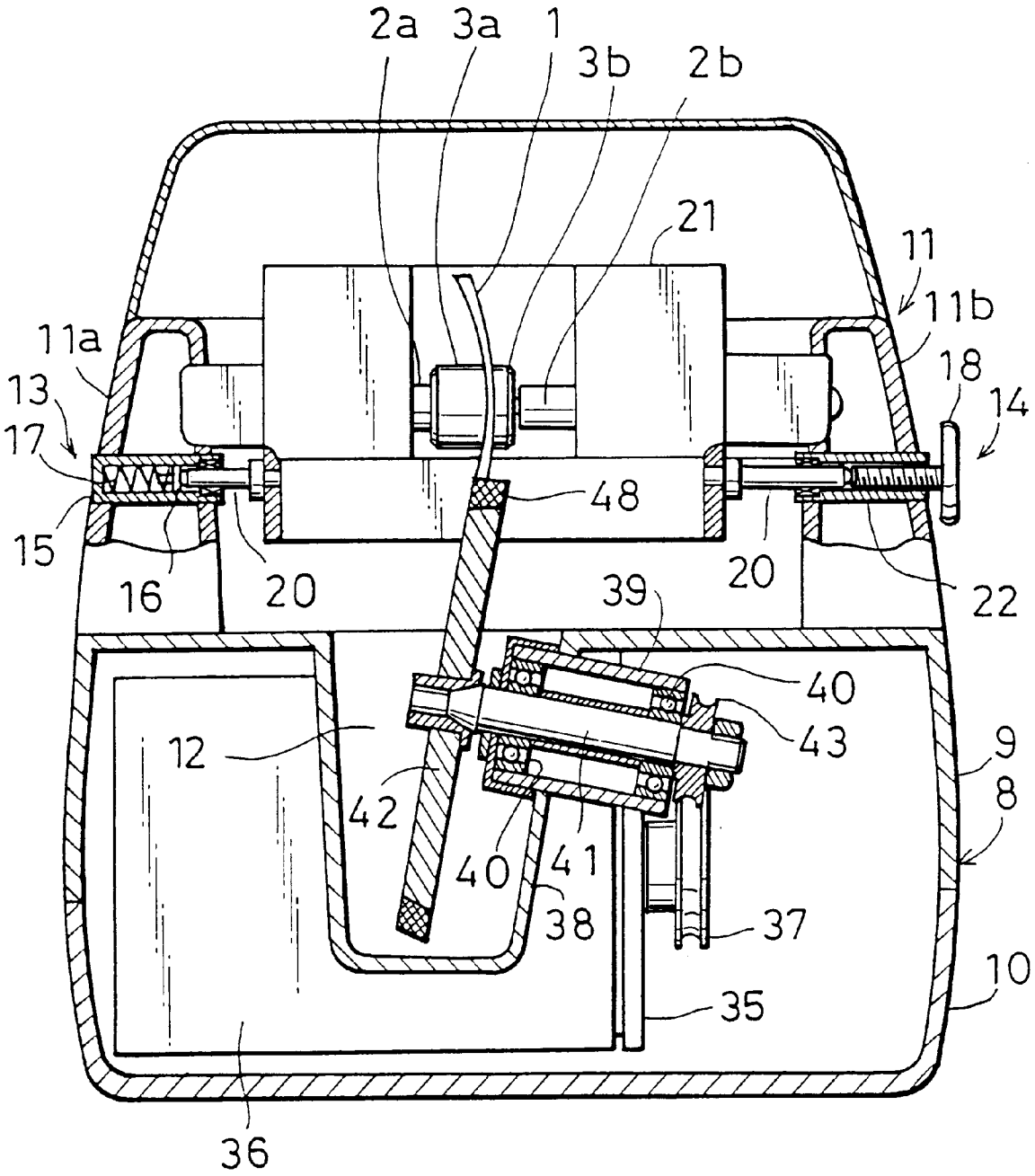
FIG. 2 is an arrow diagram along the line A—A in FIG. 1.
Figure 3:
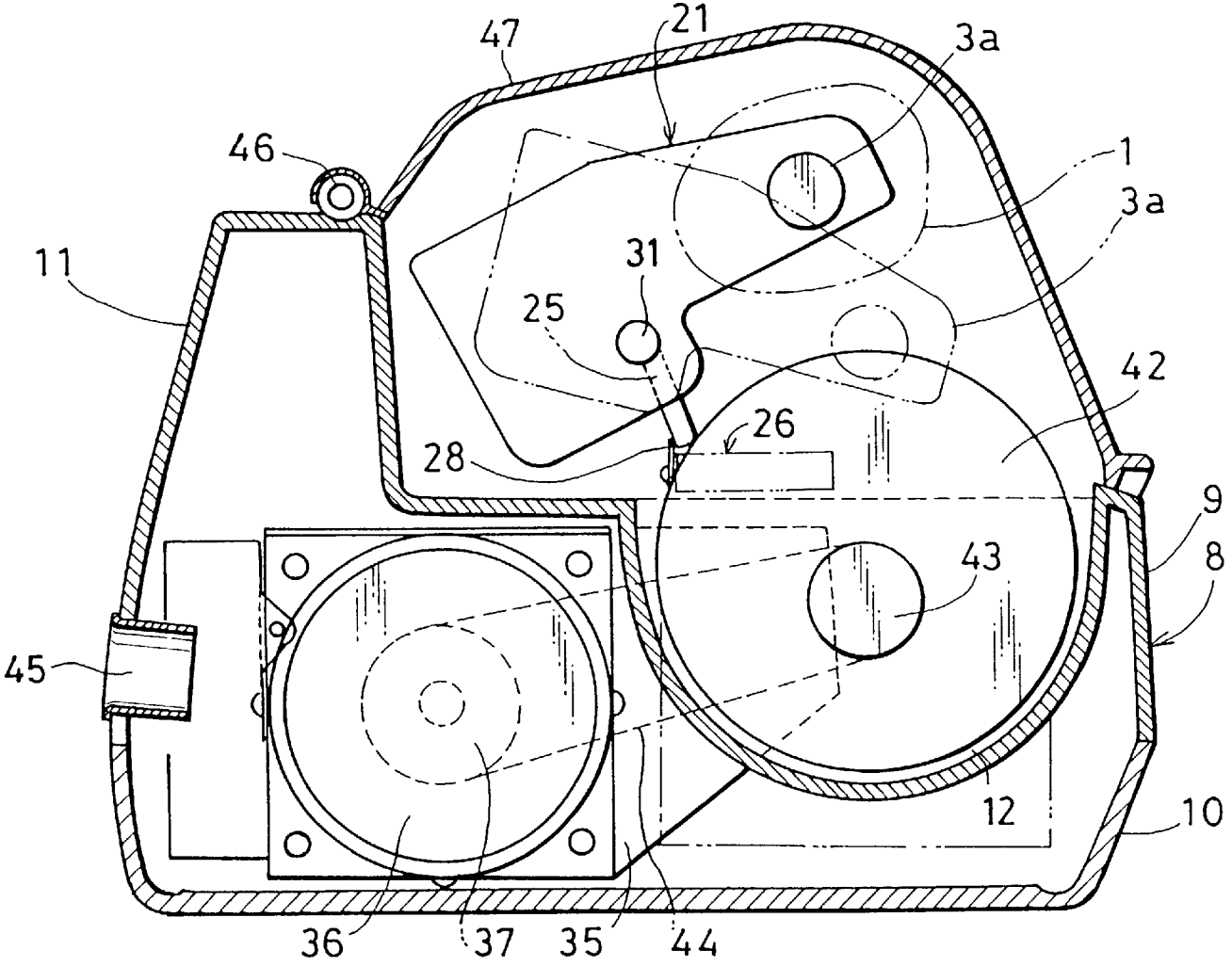
FIG. 3 is an arrow diagram along the line B—B in FIG. 1.

When the derricking shafts 20 and 20 are engaged with the shaft supports 13 and 14, the derricking frame 21 is pushed rightward by the compression spring 17. As shown in FIG. 2, the derricking shaft 20 at right is pressed against the shaft support 14. The position of the derricking frame 21 in left-right direction is determined by the position of the tip of the positioning adjusting bolt 18. By rotating the positioning adjusting bolt 18 to adjust an engaged length with the shaft support 14, it is possible to adjust the position of the derricking frame 21 in left-right direction in FIG. 2.

In the derricking frame 21, a pair of lens chuck shafts 2*a* and 2*b* at left and right respectively are rotatably arranged, and lens chucks 3*a* and 3*b* are mounted on tips of the lens chuck shafts 2*a* and 2*b* respectively. One of the lens chuck shafts, i.e. the lens shaft 2*b*, is movable in left-right direction, and a lens 1 of eyeglasses can be held between the lens chucks 3*a* and 3*b*.

In the derricking frame 21, a lens rotating motor 23 is mounted via a motor mounting plate (not shown). The lens rotating motor 23 rotates the lens chuck shaft 2*a*, and, when rotated in reverse direction, it lifts up the derricking frame 21. The derricking frame 21 is adjusted as a whole in such manner that weight balance is kept. Thus, tips of the lens chuck shafts 2*a* and 2*b* go down and buffing pressure is maintained at a constant level by a balancing mechanism 30, which has a balance spring 29.

Now, description will be given on the balancing mechanism 30. On the motor mounting plate, an arm 25 is pivotally mounted via a pin 31, and an upper end of the arm 25 is engaged with a swing arm 32 to be described later, and its lower end is engaged with a shock absorber 26. The shock absorber 26 has a slide shaft 27, which is mounted to slide in horizontal direction. On the tip of the slide shaft 27, a flange 28 engaged with the lower end of the arm 25 is fixed, and the slide shaft 27 is pushed by a buffer spring 34 arranged in the shock absorber 26 so that it is moved in a contracting direction.

Figure 4:
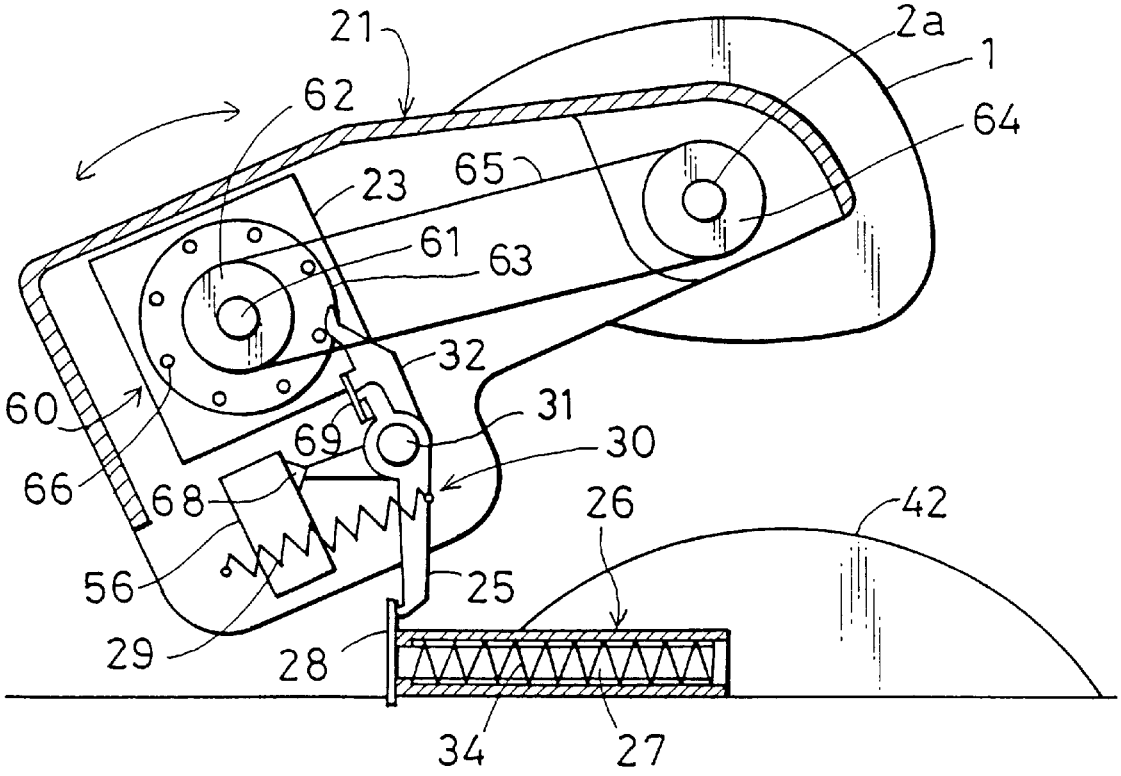
FIG. 4 is an arrow diagram along the line C—C in FIG. 1.
Figure 5:
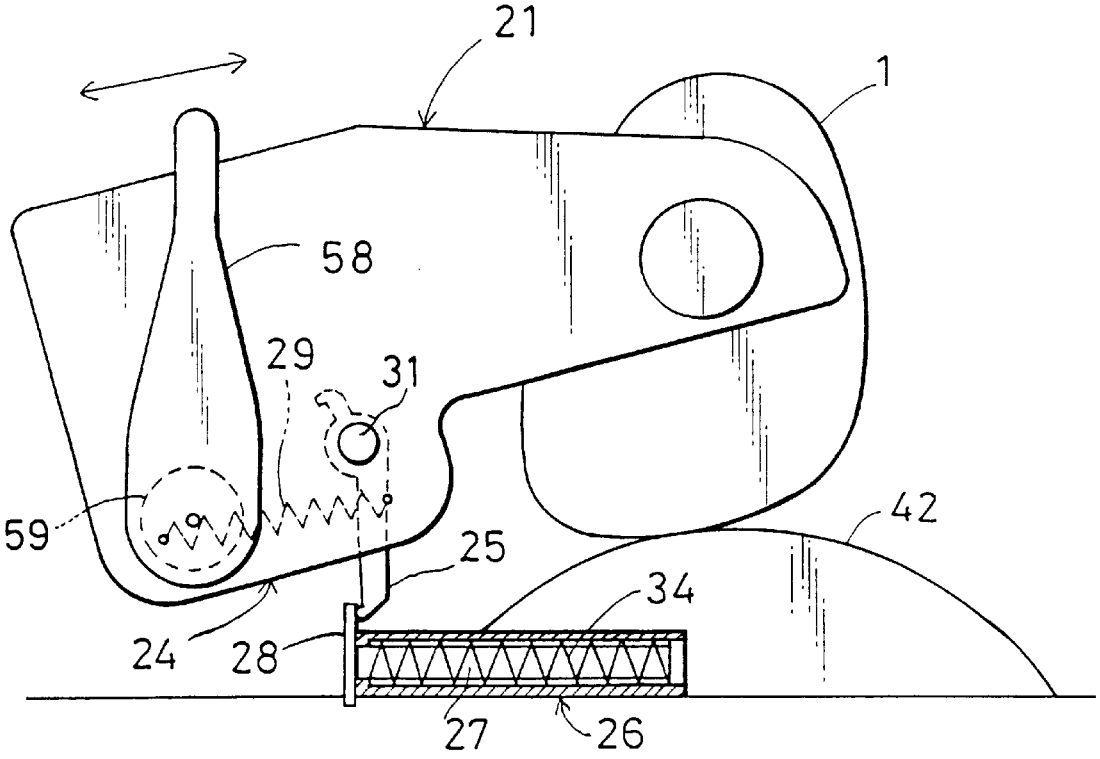
FIG. 5 is an arrow diagram along the line D—D in FIG. 1.

One end of the balance spring 29 is connected with the arm 25 to rotate the arm 25 clockwise in FIG. 4. The balance spring 29 applies a force on the slide shaft 27 to pull it out. However, it is designed in such manner that resilient force of the buffer spring 34 is higher than that of the balance spring 29 and that the slide shaft 27 is not pulled out in normal operation. On the outer side of the derricking frame 21, a buffing pressure adjusting lever 58 is rotatably mounted via a shaft 59, and the shaft 59 of the buffing pressure adjusting lever 58 is designed in shape of a disk and penetrates the derricking frame 21. The other end of the balance spring 29 is attached at an eccentric position on the inner end surface of the shaft 59. By rotating the buffing pressure adjusting lever 58, a stretching length of the balance spring 29 can be adjusted.

As described above, the lens rotating motor 23 rotates the lens 1 of eyeglasses and elevates the derricking frame 21. Description will be given below on a driving mechanism 60, which is driven by the lens rotating motor 23.

On a rotation shaft 61 of the lens rotating motor 23, a driving pulley 62 is engaged and a pin wheel 63 is mounted. On the lens chuck shaft 2*a*, a driven pulley 64 is engaged, and a belt 65 is stretched across the driving pulley 62 and the driven pulley 64.

The pin wheel 63 is designed in such manner that pins 66 are arranged at positions equally spaced on the same circumference, and the upper end of the swing arm 32 as mentioned above slidably touches one of the pins 66 at a time. The swing arm 32 is designed in shape of an elbow. Its upper end is curved toward a tangential direction on the circumference where the pins 66 are arranged. Its lower end can be brought into touch with a button 68 of a microswitch 56.

A part of the upper arm of the swing arm 32 is bent in a perpendicular direction to form a connecting piece 69, which is brought into contact with and engaged on the upper end of the arm 25. On the swing arm 32, a spring (not shown) is mounted, which pushes the upper end of the swing arm 32 toward the pin wheel 63.

In the case 8, a vertically erected motor baseplate 35 is installed in front-rear direction, and a motor 36 for buff wheel is horizontally fixed on the motor baseplate 35. On the output shaft of the motor 36 for buff wheel, a driving pulley 37 is engaged.

A shaft housing 39 penetrates a recessed wall 38 of the case 8, which faces to the recess 12. The axis of the shaft housing 39 is tilted with respect to the axes of the derricking shafts 20 and 20. On each end of the shaft housing 39, bearings 40 and 40 are provided, and a buff wheel rotation shaft 41 is rotatably mounted via these bearings 40 and 40. Because the axis of the shaft housing 39 is tilted with respect to the axes of the derricking shafts 20 and 20, the buff wheel rotation shaft 41 is also supported with tilt. For example, as shown in FIG. 2, it is supported with downward inclination with respect to a horizontal line from its end protruding into the recess 12 to its end protruding in the case 8.

On the end protruded into the recess 12 of the buff wheel rotation shaft 41, a buff wheel 42 is fixed. On its end protruding in the case 8, a driven pulley 43 is mounted, and a belt 44 is stretched across the driven pulley 43 and the driving pulley 37.

The buff wheel 42 comprises a plurality of circular buff cloths 48, which are overlapped each other and sewn up in multiple concentric arrangement, and the peripheral end surface of the buff wheel 42 serves as a buffing surface. The buffing surface, i.e. the peripheral end surface, is a part of conical curved surface having its center on the axis of the buff wheel rotation shaft 41, and it is horizontal at the uppermost position of the buff wheel 42, i.e. the position where it is brought into contact with the lens 1 of eyeglasses. The outermost peripheral position where the buff cloth 48 is sewn up in circular shape on the buff wheel 42 is closer to the center than the outer peripheral end of the buff wheel 42. The outer peripheral portion of the buff wheel 42 (the portion marked with cross hatch in FIG. 2) is loose and has softness similar to that of one piece of the buff cloth 48.

On the rear surface of the case 8, a suction port 45 is provided, to which a dust collecting duct 49 is connected. A hinge 46 is arranged on the upper end of the rear portion of the wall 11, and a dust protective cover 47 is mounted on the upper case 9 via the hinge 46 so that it can be freely opened or closed.

Figure 8:
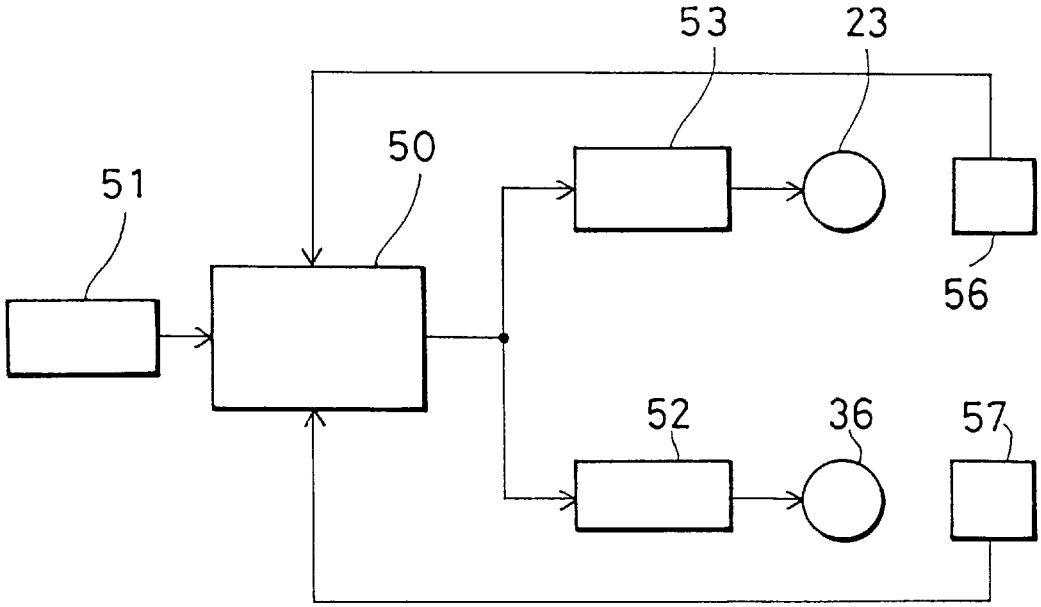
FIG. 8 is a schematical block diagram of the above embodiment of the present invention.

FIG. 8 is a schematical control block diagram of the above embodiment of the invention. An input unit 51 is connected to a control unit 50 where buffing operation sequence is set and inputted. The control unit 50 issues a driving signal to a driving unit 52 of the motor 36 for buff wheel and also issues a driving signal to a driving unit 53 of a lens rotating motor 23, which rotates and drives the lens chuck shaft 2. ON-OFF signal of the microswitch 56 is inputted to the control unit 50. When ON-OFF signal is inputted from the microswitch 56, the control unit 50 issues a signal to a timer 57 to operate it, and the timer 57 issues a signal to the control unit 50 after a predetermined time has elapsed.

Next, description will be given on buffing operation.

The dust protective cover 47 is opened, and the lens 1 of eyeglasses is chucked by the lens chucks 3*a* and 3*b* of the lens chuck shafts 2*a* and 2*b*, and by adjusting the positioning adjusting bolt 18, positioning of the lens 1 of eyeglasses and the buff wheel 42 is performed. The dust protective cover 47 is closed, and buffing operation is started by pressing a start button (not shown) of the input unit 51.

Prior to the start of the buffing operation, the derricking frame 21 is at lift-up position as shown in FIG. 4. Downward movement of the derricking frame 21 (rotation in the clockwise direction in FIG. 4) is restricted because rotation of the swing arm 32 is constrained by the engagement of the connecting piece 69 and the upper end of the arm 25 and rotation of the arm 25 is constrained by the shock absorber 26.

Figure 6:
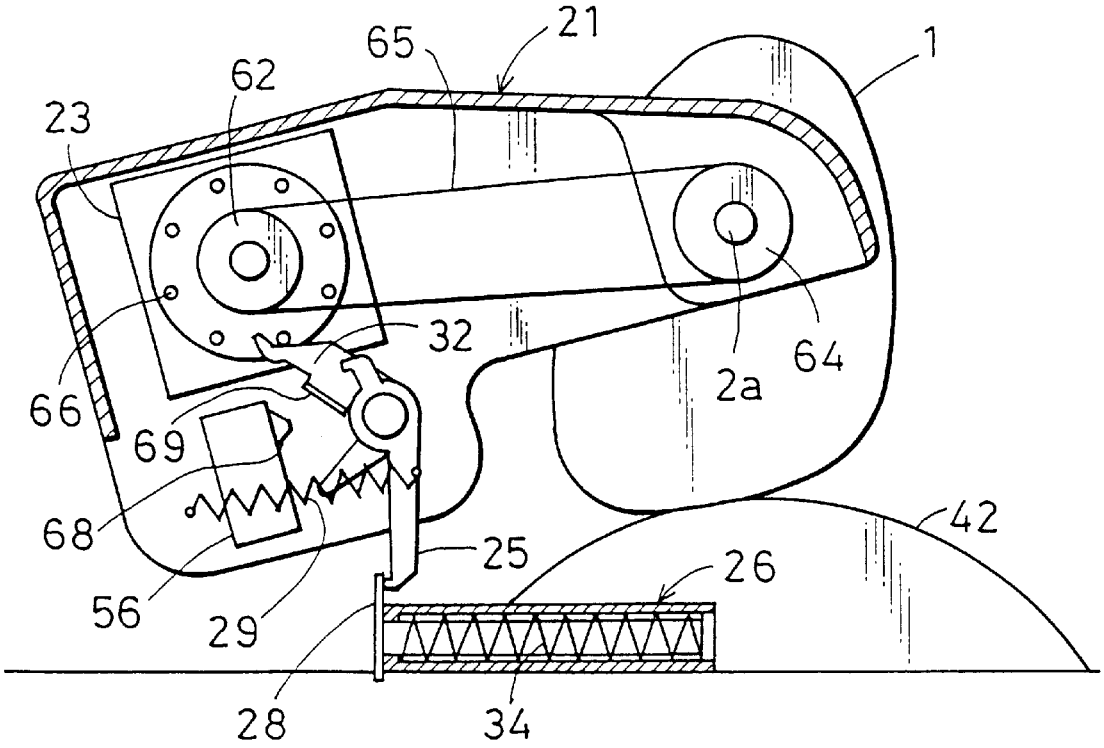
FIG. 6 is an arrow diagram along the line C—C in FIG. 1 to show buffing condition.
Figure 7:
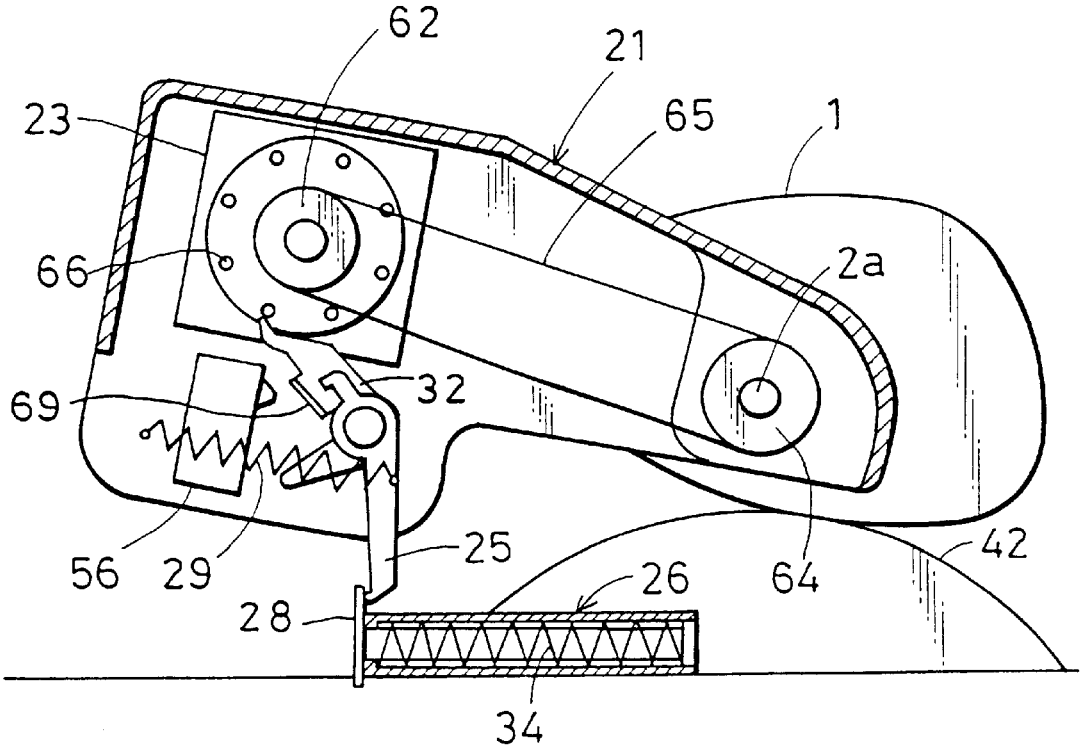
FIG. 7 is an arrow diagram along the line C—C in FIG. 1 to show buffing condition.

When an instruction to start the buffing operation is given from the input unit 51, the control unit 50 first rotates the motor 36 for buff wheel via the driving unit 52. When the motor 36 for buff wheel is rotated at steady speed, the input unit 51 is operated and the lens rotating motor 23 is driven in the normal rotating direction (clockwise in FIG. 4) by the control unit 50 via the driving unit 53. The lens rotating motor 23 rotates the lens 1 of eyeglasses via the driving pulley 62, the belt 65, the driven pulley 64, and the lens chuck shaft 2*a*. The lens rotating motor 23 rotates the pin wheel 63 in the clockwise direction. By the clockwise rotation of the pin wheel 63, the swing arm 32 is rotated by a predetermined angle in the counterclockwise direction, and the engagement between the connecting piece 69 and the upper end of the arm 25 is released (See FIG. 6). The derricking frame 21 is rotated clockwise by its own weight, and the lens 1 of eyeglasses is brought into contact with the buff wheel 42, and buffing operation is started. Contact pressure of the lens 1 of eyeglasses on the buff wheel 42 is adjusted in advance to an adequate value. Further, the derricking frame 21 is moved up and down with the change of diameter of the lens, and its angle with respect to a horizontal line is changed. With this angular change, the buffing pressure applied by self-weight is changed. The balance spring 29 is contracted or expanded according to the elevation angle and maintains the buffing pressure at a constant level (See FIG. 7). An adequate buffing pressure can be obtained by rotating the buffing pressure adjusting lever 58 and by determining an initial deflection amount of the balance spring 29.

As described above, the buff cloth 48 of the buff wheel 42 is sewn up at the position closer to the center from the circumference, and the peripheral portion of the buff wheel 42 (the portion marked with cross hatch in FIG. 10) is maintained loose and soft. Thus, when the buff wheel 42 is rotating, adequate elasticity and rigidity are given to the peripheral portion by centrifugal force applied on the buff cloth 48. The lens 1 of eyeglasses is buffed as it is floated from the peripheral portion by repulsion. As a result, no excessive buffing pressure is applied on the lens 1 of eyeglasses. Therefore, generation of heat due to friction is hindered and the lens is not damaged even in case a lens made of thermoplastic material is buffed.

During buffing, the peripheral portion of the buff wheel 42 is well adapted to the end surface of the lens 1 of eyeglasses, and it is possible to buff the end surface of the lens (See FIG. 10) in satisfactory manner.

As the lens 1 of eyeglasses is brought into contact with the buff wheel 42 so as to be buffed, the lens 1 of eyeglasses is rotated by the lens rotating motor 23. The duration of lens buffing is set by the timer 57 or by the number of revolutions. After the preset time has elapsed, a signal is inputted from the timer 57 to the control unit 50. Upon receipt of the signal, the control unit 50 issues a signal to the driving unit 53 and rotates the lens rotating motor 23 in the reverse direction (counterclockwise in FIG. 4). By reverse rotation of the lens rotating motor 23, the pin wheel 63 is rotated in the reverse direction, and the swing arm 32 is rotated clockwise in FIG. 4. The connecting piece 69 is brought into contact with the upper end of the arm 25, which is then rotated clockwise. The lower end of the arm 25 is in contact with and is constrained by the flange 28, and the derricking frame 21 is rotated counterclockwise and is raised.

When the derricking frame 21 is raised to the initial state, the lower end of the swing arm 32 pushes the button of the microswitch 56, and ON-OFF signal is issued to the control unit 50. The control unit 50 confirms the operation of the microswitch 56 and stops the rotation of the lens rotating motor 23 and the motor 36 for buff wheel via the driving units 52 and 53. Thus, the buffing operation is completed.

During the buffing operation, the dust protecting cover 47 is closed, and the buffing machine for lens is kept in enclosed state. Because the air is sucked from the buffing machine for lens via the suction port 45, the dust generated during buffing does not come out of the buffing machine for lens, and no contamination of the air occurs in the operation room.

When the motor 36 for buff wheel is stopped, a series of buffing operation is completed, and it is possible to take out the lens 1 of eyeglasses.

Figure 9:
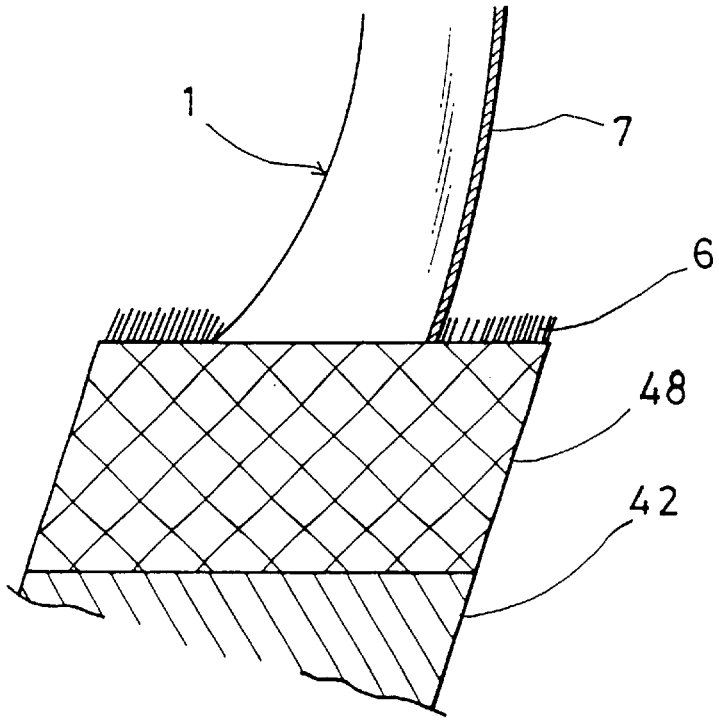
FIG. 9 is a drawing to show buffing condition in the above embodiment.

Next, description will be given on the buffing condition of the present embodiment, referring to FIG. 9.

There are fluffs 6 on the surface of the buff cloth 48. When the buff wheel 42 is rotated, the fluffs are raised by centrifugal force. Because the rotation axis of the buff wheel 42 is tilted, rising or fluffing direction of the fluffs 6 is tilted with respect to the buffing surface. The tilting direction of the fluffs 6 is directed away from +curved (i.e. convex) front surface of the lens 1 of eyeglasses. As a result, the peripheral edge of the front surface of the lens 1 of eyeglasses is not buffed by the fluffs 6, and the coating 7 is not damaged by buffing of the end surface of the lens 1 of eyeglasses. Further, it is preferable that the fluffs 6 are tilted in a direction away from the tangential direction on the front surface of the lens 1 of eyeglasses. Although not shown in the figure, when the lens 1 of eyeglasses is pushed against the buff cloth 48, the fluffs 6 are laid down outwardly, and this further reduces the chance to buff the front surface of the lens.

The tilting direction of the bearings 40 and 40 is not necessarily tilted with respect to the horizontal line. It will suffice if the bearings 40 and 40 are tilted with respect to the lens chuck shafts 2*a* and 2*b*.

Figure 10:
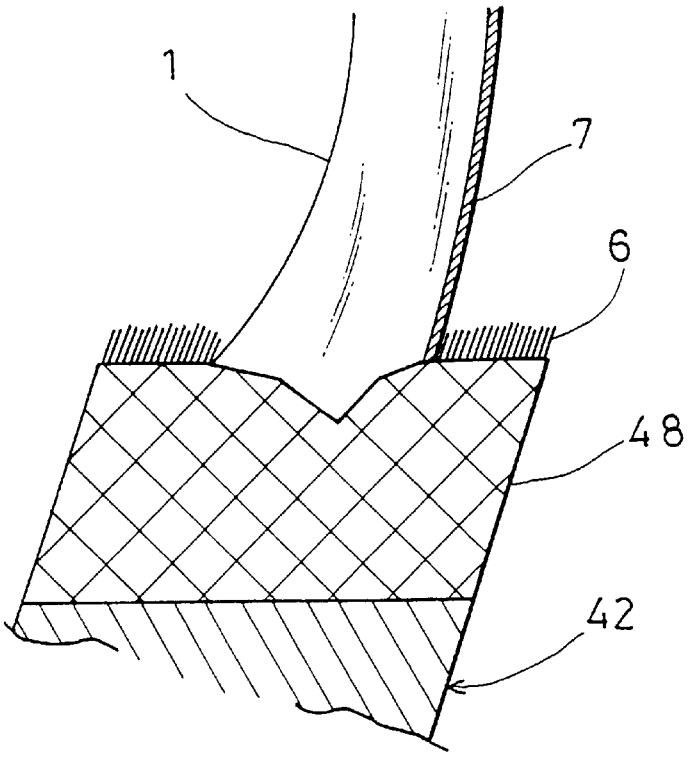
FIG. 10 is a drawing to show buffing condition in case an end surface of a lens is not flat.
Figure 11:
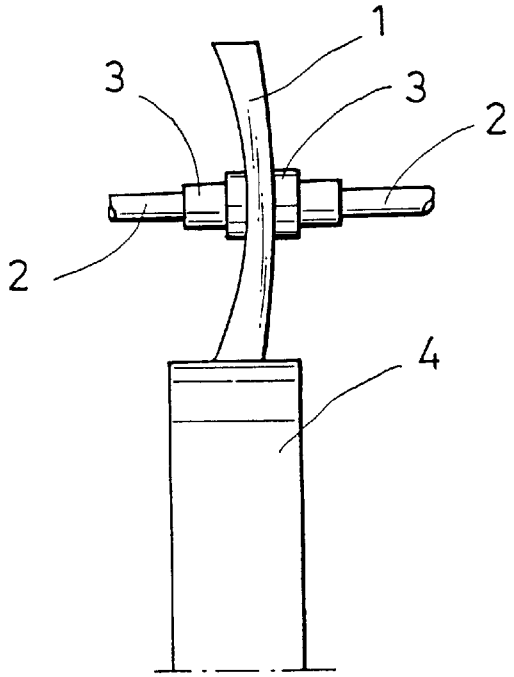
FIG. 11 (PRIOR ART)
FIG. 11 is a drawing to explain a conventional type buffing machine for lens.
Figure 12:
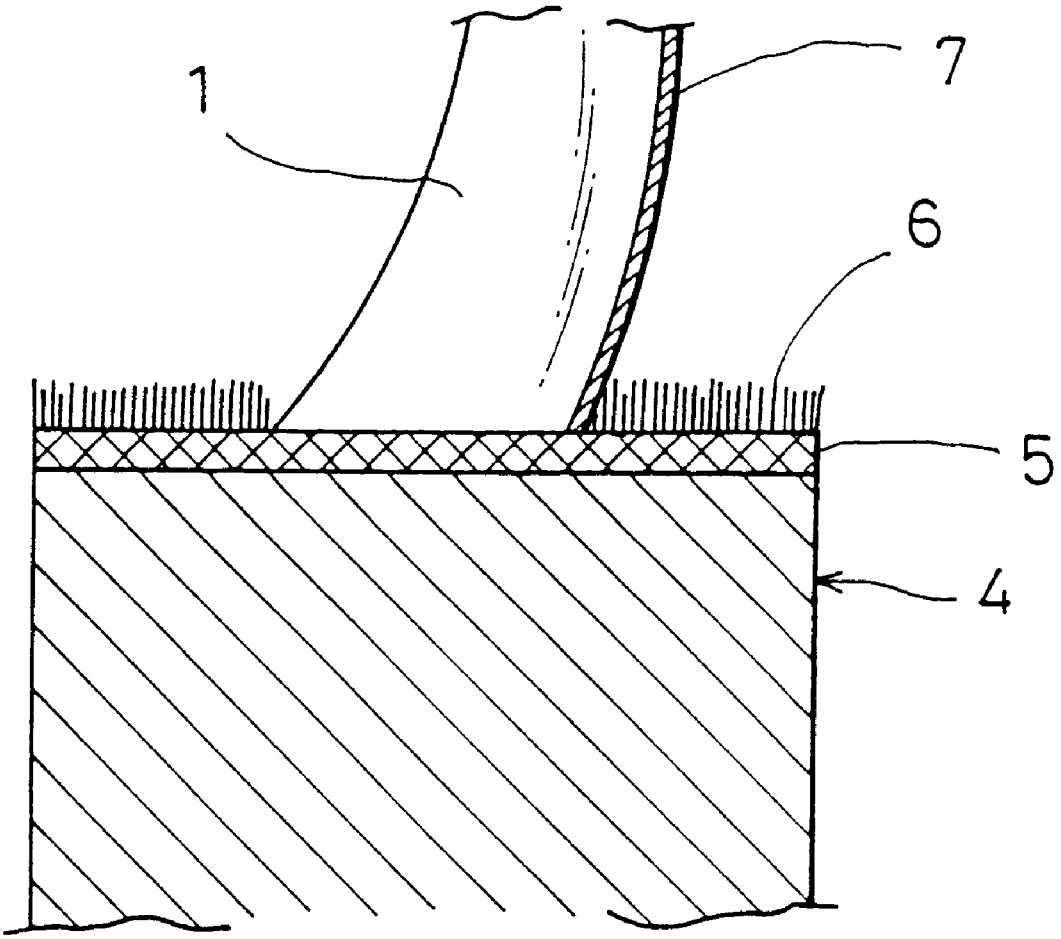
FIG. 12 (PRIOR ART)
FIG. 12 is a drawing to explain buffing condition of the conventional type buffing machine for lens.

In the present invention, centrifugal force caused by rotation of the buff wheel and pushing force of the buff wheel on the lens are adequately adjusted, and peripheral edge of the lens are somewhat buried and buffed in floating condition as shown in FIG. 10. As a result, the buff cloth follows the shape of the end surface of the lens and evenly touches it. Even when the end surface of the lens is V-shaped, it is possible to evenly buff on the entire surface.

As described above, according to the present invention, coating is not damaged when the end surface of the lens is buffed. Because the peripheral portion of the buff wheel is designed loose, no excessive buffing pressure is applied on the lens during buffing. This makes it possible to buff even a lens made of thermoplastic material in satisfactory manner and to obtain good buffing surface regardless of the shape of the end surface of the lens, and product quality of the lens is not decreased due to buffing.

What we claim are:

1. A buffing machine for a lens, comprising chuck shafts for chucking an eyeglass lens having a first surface and an end surface and for rotatably supporting said eyeglass lens, and a buff wheel having a rotation axis and a buffing surface having a plurality of fluffs for buffing said end surface of said eyeglass lens, wherein said rotation axis of said buff wheel is tilted with respect to said chuck shafts such that said fluffs are directed away from said first surface of said eyeglass lens during buffing, and wherein said buffing surface of said buff wheel is a conical curved surface.

2. A buffing machine for a lens according to claim 1, wherein said buff wheel has a peripheral portion, and said peripheral portion of said buff wheel is loose.

3. A buffing machine for a lens according to claim 1, further comprising an elevatably supported derricking frame for supporting said chuck shafts, supporting means for supporting said derricking frame; and a balance spring arranged on said derricking frame; and wherein buffing pressure is provided at least in part by the self-weight of a lens support including said derricking frame, and said balance spring is contracted or expanded according to an angle of said derricking frame to hinder change of the buffing pressure.

4. A buffing machine for a lens according to claim 3, wherein an arm having a tip is rotatably mounted on the derricking frame, said tip of the arm is brought into contact with said supporting means, and said balance spring is stretched across said derricking frame and said arm.

5. A buffing machine for a lens according to claim 3 or 4, further comprising a buffing pressure adjusting lever rotatably mounted on said derricking frame, and wherein said balancing spring is arranged between said buffing pressure adjusting lever and said arm.

* * * * *